United States Patent [19]

Granberg

[11] 4,063,766

[45] Dec. 20, 1977

[54] SASH LOCK

[76] Inventor: Fred Granberg, 5736 S. Rockwell St., Chicago, Ill. 60629

[21] Appl. No.: 699,538

[22] Filed: June 24, 1976

[51] Int. Cl.[2] ..... E05C 3/04

[52] U.S. Cl. ..... 292/336; 292/242

[58] Field of Search ..... 292/336, 241, 242

[56] References Cited

U.S. PATENT DOCUMENTS

| | | | |
|---|---|---|---|
| 894,571 | 7/1908 | Barber et al. | 292/336 |
| 1,077,312 | 11/1913 | Sloan | 292/336 |
| 1,651,048 | 11/1927 | Talbot | 292/336 |
| 2,645,515 | 7/1953 | Thomas, Sr. | 292/336 |
| 2,846,258 | 8/1958 | Granberg | 292/336 |

*Primary Examiner*—Richard E. Moore

*Attorney, Agent, or Firm*—Wegner, Stellman, McCord, Wiles & Wood

[57] ABSTRACT

An automatically operable window sash lock having a gravity-biased latch plate locking element. The latch plate is biased to a locking position wherein the latch plate is engaged with a catch. The latch structure may be mounted on one window member and the catch may be mounted on an adjacent window member. The latch structure is arranged to cause the latch plate to move to the locked position automatically as the result of the window members being moved to a closed position. The latch structure is further arranged to be retained in a retracted position when it is desired to move the window members to an open position.

13 Claims, 7 Drawing Figures

SASH LOCK

BACKGROUND OF THE INVENTION

1. Field of the Invention

This invention relates to window sash locks and in particular to window sash locks having automatic means for effecting a locking operation as an incident of movement of the window members to te closed position.

2. Description of the Prior Art

A number of improved sash lock structures are shown in applicant's prior U.S. Letters Pat. Nos. 2,421,196, 2,480,016 and 2,846,258. In each of these patents, a sash lock is disclosed for use in locking relatively movable members. In each sash lock, a latch plate is pivotally mounted to a base for selective engagement with a catch carried on the other window member.

In U.S. Pat. No. 2,480,016, a locking element is provided for providing an automatic locking of the structure when the window members are brought to the closed position.

In U.S. Pat. No. 2,846,258, an improved lock structure is provided wherein a control member is biased by a spring to provide the desirable control functioning.

In U.S. Letters Pat. No. 2,884,276 of Arthur H. Baptist, which patent is owned by applicant hereof, an automatic window sash lock is disclosed wherein the control means is mounted on a mounting plate secured to the latch base. The control means is provided with a biasing spring to function generally similarly to the functioning of the Granberg U.S. Pat. No. 2,486,258 sash lock.

SUMMARY OF THE INVENTION

The present invention comprehends a further improved sash lock latch structure having a gravity-biased means for locking the latch plate releasably in the retracted position and means for overcoming the gravity-biased means to release the latch plate for movement to the locking position automatically as a function of the movement of the window members on which the sash lock structure is mounted.

The invention is directed to the control means associated with the latch portion of the sash lock means. More specifically, the improved control structure includes a control member having a mounting portion pivotally associated with the latch base.

The control member may further have a lock portion and a trip portion. In the illustrated embodiment, the lock portion and trip portion define turned portions at opposite ends of the mounting portion.

Further more specifically in the illustrated embodiment, the trip portion may have a weight substantially greater than that of the lock portion so as to provide the gravity biasing of the control member about the axis of the mounting portion.

The lock portion and trip portion may extend radially to the axis of the pivotal mounting portion, and in the illustrated embodiment, are displaced angularly about the axis. More specifically in the illustrated embodiment, the lock portion and trip portion are displaced approximately 90°.

The trip portion may have a curved distal end.

Shoulder means may be provided on the latch plate for moving the latch plate mounting portion axially as a function of the movement of the latch plate. More specifically, the latch plate shoulder means effects a movement of the mounting portion rearwardly as a result of a movement of the latch plate to a retracted position whereby the trip portion is correspondingly moved rearwardly toward the latch structure base such as for permitting relative unimpeded movement between the window members.

The base may be provided with shoulder means cooperating with the control member to prevent return of the latch plate to the locking position by its spring biasing means. The latch plate may include means adapted to engage the lock portion of the control member, with the lock portion, in turn, engaging the shoulder of the base to retain the latch plate in the retracted position. In the retracted position, the trip portion of the control member is urged forwardly so as to be in the path of movement of the window member on which the catch is mounted so that as that window member is brought back to a closed position, the trip portion is moved so as to release the lock portion of the control member from its engagement with the latch plate, thereby permitting the latch plate to be swung by its biasing means to the locking position in locked association with the cooperating catch.

Thus, in the present invention, the control member is freely movable on its mounting means with the lock portion thereof being gravity-biased to the locked position and with the mounting portion thereof being readily freely movable axially reciprocably between the forward locked position and the rearward retracted position.

Thus, the sash lock structure of the present invention is extremely simple and economical of construction eliminating the spring biasing means of the prior art structures and providing an improved automatic self-locking of associated window members.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
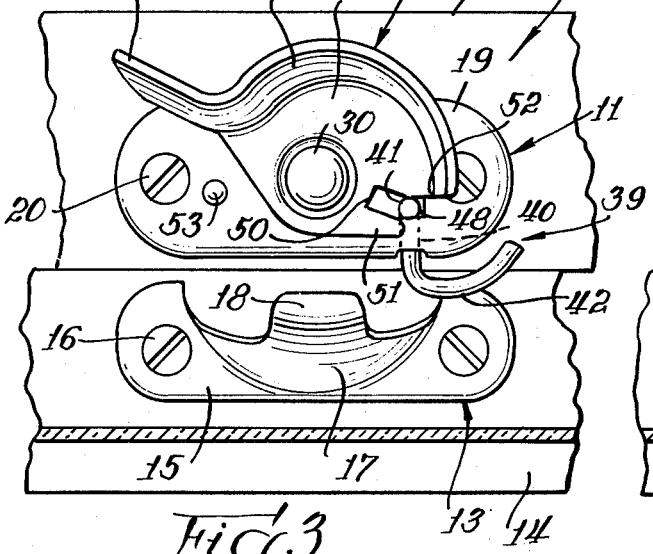
FIG. 1 is a top plane view of a sash lock having a latch structure embodying the invention, the sash lock elements being illustrated as mounted on sash portions of associated window members.

In the exemplary embodiment of the invention as disclosed in the drawing, a sash lock generally designated 10 includes a latch structure generally designated 11 mounted on a first window member sash 12, and a catch generally designated 13 mounted on a second window member sash 14.

Figure 3:
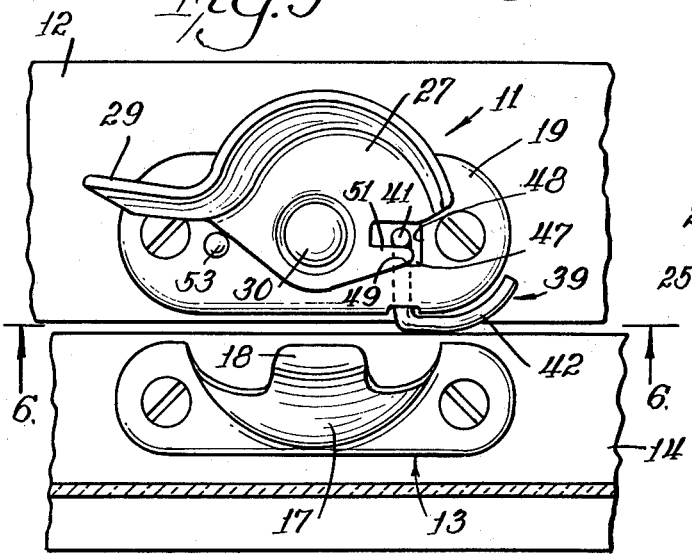
FIG. 3 is a top plan view thereof with the sash lock in the retracted position.
Figure 7:
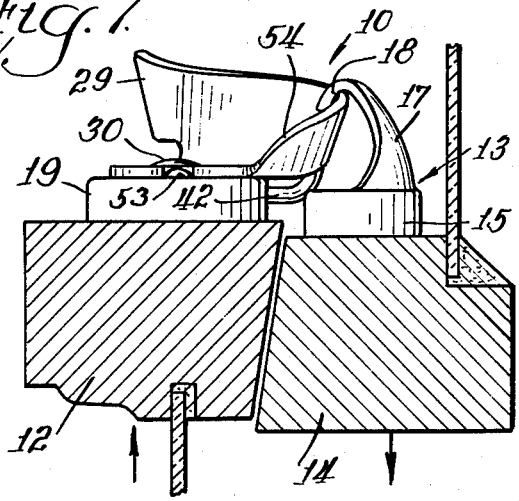
FIG. 7 is a side elevation of the latch structure in the closed position, illustrating the locking action where the top sash has sagged.

As shown in FIG. 7, the window members 12 and 14 are relatively vertically movable from the closed position thereof upon release of the sash lock from the locking position shown in FIG. 7 to a retracted position shown in FIG. 3. As shown in FIG. 7, the window member 14 may be movable downwardly, and the window member 12 may be movable upwardly from the locked position upon release of the sash lock 10.

As shown in FIG. 1, catch 13 comprises a conventional catch having a mounting portion 15 secured to the check rail of the window member 14 as by suitable screws 16. The catch further includes an upstanding midportion 17 having a downturned lip 18 facing toward window member 12 in the installed arrangement of the catch.

Figure 4:
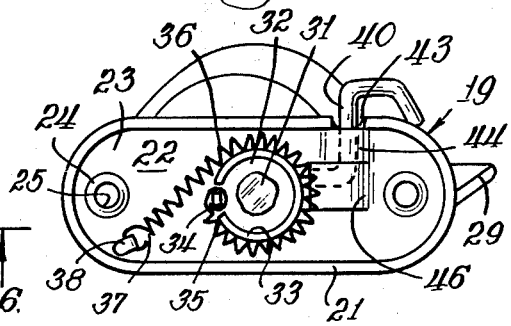
FIG. 4 is a bottom plan view of the latch structure thereof with the latch plate in the closed position.
Figure 5:
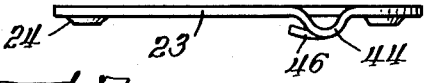
FIG. 5 is a side elevation of the mounting plate portion of the base.

Latch structure 11 includes a base 19 which may be secured to the window member 12 by suitable means, such as screws 20. As shown in FIG. 4, the base includes a peripheral wall 21 defining a downwardly opening recess 22 in which is received a mounting plate 23. Plate 23 is retained within recess 22 by staked portions 24 surrounding the screw holes 25.

The latch structure further includes a latch plate generally designated 26 having a carrier portion 27 facially overlying the base 19. Upstanding from the carrier is a locking wall 28 terminating in an outwardly extending handle portion 29.

The latch plate is pivotally mounted to the base by means of a pivot post 30 extending through carrier portion 27. The lower end 31 of the post 30 is staked outwardly to retain a cup-shaped spring guide 32 rotatably against the underside of the base 19 and rotatably within an opening 33 within the carrier plate 23. The spring guide is provided with a tab 34 to which one end 35 of a tension coil spring 36 is secured. The coil spring is wrapped around the guide and the opposite end 37 of the spring is retained by a tab 38 on plate 23. Thus, spring 36 biases the latch plate 26 to the locking position of FIGS. 2 and 4, i.e., in a clockwise direction as seen in FIG. 2 and a counterclockwise direction as seen in FIG. 4.

Figure 2:
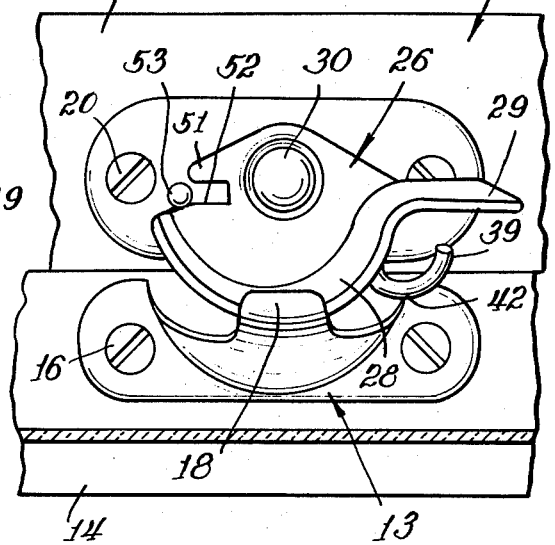
FIG. 2 is a top plan view thereof with the sash lock in the locked position.

As indicated briefly above, the invention comprehends an improved lock tripping means for effecting an automatic transfer of the latch plate 26 from the retracted position of FIG. 1 to the locking position of FIG. 2. In the illustrated embodiment, the automatic lock tripping means generally designated 39 comprises a gravity-biased control member having a mounting portion 40, a latch plate lock portion 41, and a trip portion 42 which is heavier than the lock portion 41. Base wall 21 includes a notch 43 through which the mounting portion 40 extends. The mounting plate 23 is provided with a U-shaped boss 44 which cooperates with the overlying base 19 to define a journal pivotally mounting the control member mounting portion 40 for rotation about its longitudinal axis.

Figure 6:
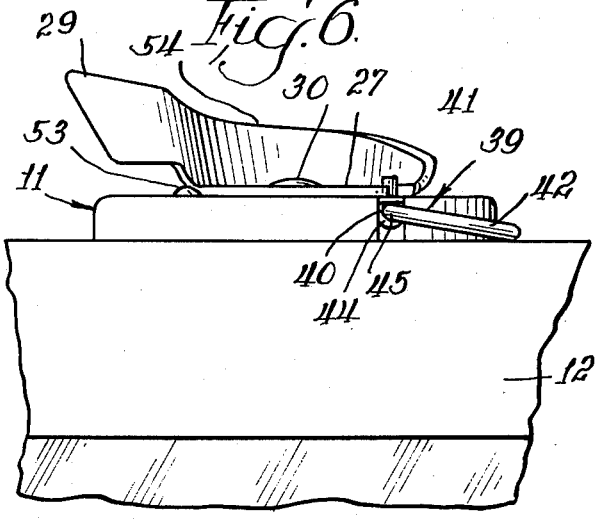
FIG. 6 is a front elevation of the latch structure in the retracted position of FIG. 3.

As best seen in FIG. 6, lock portion 41 of the control member extends radially to the axis 45 of the mounting portion, and trip portion 42 extends radially thereto generally perpendicularly to the lock portion 41. In the illustrated embodiment, the angular spacing between trip portion 42 and lock portion 41 is slightly over 90°.

Plate 23 is provided with a rectangular opening 46 and base 19 is provided with a corresponding opening 47 for passing the lock portion 41 upwardly into the path of movement of the latch plate carrier 27.

As shown in FIG. 6, the length of trip portion 42 is substantially greater than the length of lock portion 41 so that the trip portion effectively gravity biases the control member in a clockwise direction, as seen in FIG. 6, to cause the lock portion 41 to extend upwardly into the path of movement of the carrier 27, as discussed above. The pivoting of the control member is limited by the engagement of the lock portion 41 with an end surface 48 of the base opening 47. Forward movement of the lock portion 41 is limited by engagement thereof with a forward end surface 49 of the opening 47.

Latch plate carrier portion 27 is provided with a radially outwardly opening notch 50 defined by a forward finger 51 and a rear edge 52. In the open condition of the sash lock 10, as shown in FIG. 2, edge 52 engages a stop boss 53 to limit the clockwise rotation of the latch 26 on post 30 to the closed position wherein the locking wall underlies catch lip 18.

To open the window, the user repositions sash lock 10 to the open position of FIG. 3 by manually operating handle 29 of the latch plate to pivot the latch plate in a counterclockwise direction from the arrangement of FIG. 2 to the arrangement of FIG. 3. As a result of this pivotal movement, finger 51 engages the upstanding lock portion 41 to move the control member 39 rearwardly and thereby bring trip portion 42 rearwardly from overlying relationship to the window sash 14, thereby permitting relative movement between the window members.

Upon release of the handle 29, spring 36 urges the latch plate in a clockwise direction to reposition the control member 39 from the fully retracted position of FIG. 3 to the lock position of FIG. 1. As seen in FIG. 1, in the lock position, trip portion 42 of the control member overlies the window member 14.

When it is desired to move the window members to the closed position, relative movement therebetween is effected so as to bring the window member 14, as seen in FIG. 7, relatively upwardly whereby the trip portion 42 may be engaged by the mounting portion 15 of catch 13 to swing the control member about axis 45 in a counterclockwise direction as seen in FIG. 6, thereby to withdraw the lock portion 41 from the notch 50 and permit spring 36 to snap the latch plate in a clockwise direction from the open position of FIG. 1 to the closed position of FIG. 2 wherein the locking wall 28 engages the lip 18 of catch 13 to lock the window members in the closed position automatically.

As shown in FIGS. 6 and 7, the top surface 54 of the locking wall 28 is gradually sloped from the handle 29 to permit the locking of the wall under lip 18 notwithstanding a sagged condition of the check rail of window 14.

Thus, the present sash lock provides an improved simplified construction and simplified operation advantageously adapted for use in automatically, effectively positively locking window members when brought to a closed position. The trip portion of the control means is automatically suitably positioned to allow free opening movement of the window members when desired as an automatic function of moving the lock to the open position. The lock remains in the open position until such time as the window members are again brought to the closed position, whereupon the automatic locking operation is against effected.

The foregoing disclosure of specific embodiments is illustrative of the broad inventive concepts comprehended by the invention.

I claim:

1. In a sash lock latch structure having a base, a latch plate, means for mounting said latch plate to said base for movement between a latching position and a retracted position, and biasing means urging said latch plate to said latching position, the improvement comprising:

a control member having a mounting portion, a plate lock portion, and a trip portion;

mounting means mounting said mounting portion adjacent said base for free pivoting of said control member about a pivot axis substantially parallel to the direction of movement of said latch plate, and reciprocable rearward and forward movement of said mounting portion in the direction of said axis, said lock portion and trip portion being disposed at opposite ends of said mounting portion and extending radially therefrom, said trip portion extending angularly to the direction of radial extension of said lock portion, the control member being biased to pivot about said pivot axis in a first direction;

first shoulder means movable with said latch plate for engaging said lock portion to urge the control member rearwardly to a withdrawn position when the latch plate is moved to said retracted position with said lock portion being biased into the path of movement of said shoulder means;

second shoulder means movable with said latch plate for engaging said lock portion to urge the control member forwardly from said lock position to dispose said trip portion in a forward trip position; and third shoulder means on said base for limiting the forward movement of said lock portion to releasably retain the latch plate in the retracted position and the trip portion in the trip position, said lock portion being removed from engagement with said second shoulder means to permit said biasing means to pivot said latch plate from said retracted position to said latching position as a result of said trip portion being swung from the trip position by a pivoting of said control member in a second direction opposite to said first direction.

2. The sash lock latch structure of claim 1 wherein said control member is gravity-biased.

3. The sash lock latch structure of claim 1 wherein said trip portion has a weight substantially greater than that of said lock portion to bias said lock portion pivotally into the path of movement of said latch plate.

4. In a sash lock structure having a base, a latch plate, means for mounting said latch plate to said base for movement between a latching position and a retracted position, and biasing means urging said latch plate to said latching position, the improvement comprising:

a control member having a mounting portion, a plate lock portion, and a trip portion;

mounting means mounting said mounting portion adjacent said base for free pivoting of said control member about a pivot axis substantially parallel to the direction of movement of said latch plate, and reciprocable rearward and forward movement of said mounting portion in the direction of said axis, said lock portion and trip portion being disposed at opposite ends of said mounting portion and extending radially therefrom, said trip portion extending angularly to the direction of radial extension of said lock portion and having a weight effectively greater than that of said lock portion to gravity-bias the control member pivotally about said axis;

first shoulder means movable with said latch plate for engaging said lock portion to urge the control member rearwardly to a withdrawn position when the latch plate is moved to said retracted position with said trip portion free to bias said control member to dispose said lock portion in the path of movement of said shoulder means;

second shoulder means movable with said latch plate for engaging said lock portion to urge the control member forwardly from said lock position to dispose said trip portion in a forward trip position; and thrid shoulder means on said base for limiting the forward movement of said lock portion to releasably retain the latch plate in the retracted position and the trip portion in the trip position, said lock portion being removed from engagement with said second shoulder means to permit said biasing means to pivot said latch plate from said retracted position to said latching position as a result of said trip portion being swung against the gravitybias thereof from the trip position.

5. The sash lock latch structure of claim 4 wherein said control member comprises a rod having turned end portions defining said lock and trip portions.

6. The sash lock latch structure of claim 4 wherein said latch plate is provided with a notch defining said first and second shoulder means.

7. The sash lock latch structure of claim 4 wherein said trip portion of the control member is curved.

8. The sash lock latch structure of claim 4 wherein said lock portion of the control member is rectilinear.

9. The sash lock latch structure of claim 4 wherein said mounting portion of the control member is rectilinear.

10. The sash lock latch structure of claim 4 wherein said trip portion of the control member extends generally perpendicularly to the direction of radial extension of said lock portion.

11. The sash lock latch structure of claim 4 wherein said trip portion of the control member extends generally perpendicularly to the direction of radial extension of said lock portion and includes a rearwardly turned distal portion.

12. The sash lock latch structure of claim 4 wherein said mounting means comprises means for mounting said mounting portion of the control member on said base.

13. The sash lock latch structure of claim 4 wherein said means for mounting said latch plate comprises means for swingably mounting the latch plate about a swing axis, said lock portion of the control member extending generally parallel to said swing axis when said lock portion is biased into the path of movement of said latch plate shoulder means.

* * * * *